US005226989A

United States Patent [19]

Sukonnik

[11] Patent Number: 5,226,989

[45] Date of Patent: Jul. 13, 1993

[54] METHOD FOR REDUCING THICKNESS OF A TITANIUM FOIL OR THIN STRIP ELEMENT

[75] Inventor: Israil Sukonnik, Plainville, Mass.

[73] Assignee: Texas Instruments Incorporated, Dallas, Tex.

[21] Appl. No.: 809,689

[22] Filed: Dec. 16, 1991

[51] Int. Cl.[5] ..... C22C 14/00

[52] U.S. Cl. ..... 148/670; 148/650; 148/657; 148/669; 148/671

[58] Field of Search ..... 148/669, 670, 671, 650, 148/657

[56] References Cited

U.S. PATENT DOCUMENTS

| | | | |
|---|---|---|---|
| 3,867,208 | 2/1975 | Grekov et al. | 148/670 |
| 4,581,077 | 4/1986 | Sakuyama et al. | 148/670 |
| 4,871,400 | 10/1989 | Shindo et al. | 148/671 |
| 5,087,298 | 2/1992 | Mizoguchi et al. | 420/418 |

*Primary Examiner*—Upendra Roy
*Attorney, Agent, or Firm*—Russell E. Baumann; Richard L. Donaldson; René E. Grossman

[57] ABSTRACT

Leaders are attached to opposite ends of a titanium foil or thin strip element and are partially coiled on respective reels spaced at opposite sides of a cluster rolling mill to transfer the titanium element back and forth between the reels to move the element between pressure rolls of the mill a plurality of times and under forward and back tension in air at room temperature to initially reduce the element thickness enough to permit the element to be coiled on the reels and then to partially coil the element on the reels to further reduce element thickness. Iron aluminide material is interleaved with a loose coil of the element and the element is heated in a protective atmosphere to stress relieve and partially recrystallize the element material between the reductions in thickness.

15 Claims, 1 Drawing Sheet

METHOD FOR REDUCING THICKNESS OF A TITANIUM FOIL OR THIN STRIP ELEMENT

BACKGROUND OF THE INVENTION

The field of the invention is that of high strength titanium materials and the invention relates more particularly to methods for making thin foils of such materials.

The use of thin foils of titanium materials such as titanium aluminides and high strength titanium alloys is commonly proposed for building up fiber-reinforced sheet materials and honeycomb structural elements and the like for application in the aircraft industry and elsewhere where high strength-to-weight components are required. However, titanium materials of that character are very difficult to process into foil and thin strip elements without embrittlement and edge-cracking. Typically, for example, titanium aluminides and high strength titanium alloys are hot roll forged and are then hot pack rolled repeatedly to progressively reduce the thickness of the titanium materials. As the material thickness is reduced to the level of thin strips or foils, the amount of thickness reduction which can be achieved with each hot rolling thickness reduction pass grows smaller. Such thin strip or foil materials are thus far made for that proposed purpose only by a cumbersome, low-yield process which combines hot pack rolling with chemical milling or abrading. In that known process, sheets of a selected titanium aluminide or high strength alloy are arranged in a stack inside a metal package with a stop-weld or separator material such as lime disposed between the sheets. The metal is alternately rolled at elevated temperature in a conventional rolling mill and heat-treated for annealing the metal package and titanium materials to gradually reduce the thicknesses of the sheets in the stack toward dimensions. The metal package is then removed and the sheets in the stack are separated from each other. After pickling for removal of the separator material the sheets are then chemically milled or abraded to provide the sheets with desired surface finish and final foil dimensions, a final step which typically reduces yield of the process well below fifty percent. It would be desirable if novel and improved method could be devised for producing foils of titanium aluminide and high strength titanium alloys with high yield free of edge cracking in the foils in an economical manner.

BRIEF SUMMARY OF THE INVENTION

It is an object of the invention to provide novel and improved methods for making titanium foil and thin strip materials; to provide such methods which are particularly adapted for making thin strips and foils of titanium aluminides and high strength titanium alloys; to provide such methods for producing such titanium strip and foil materials substantially free of edge cracking in the strips and foils; to provide such methods for making thin titanium strips and foils in an economical manner; and to provide such methods which are versatile for producing thin strips and foils from various titanium materials.

Briefly described, the novel and improved method of the invention comprises the steps of providing an element of titanium aluminide or high strength titanium alloy having a desired initial length, width and thickness. Typically, for example, the element comprises a sheet of selected titanium material selected from the group consisting of alpha/alpha-2 titanium aluminides such as an intermetallic compound having a composition by weight percent of 8.5 percent aluminum, 5 percent niobium, 1 percent molybdenum, 1 percent zirconium, 1 percent vanadium and the balance titanium (Ti8.5Al5Nb1Mo1Zr1V), alpha-2 titanium aluminides such as an intermetallic compound having a composition by weight percent of 14 percent aluminum, 21 percent niobium and the balance titanium (Ti14Al21Nb), superalpha-2 titanium aluminides such as an intermetallic compound having a composition by weight percent of 14 percent aluminum, 20 percent niobium, 3.2 percent molybdenum, 2 percent vanadium and the balance titanium (Ti14Al20Nb3.2Mo2V) and such as an orthorhombic intermetallic compound having a composition by weight percent of 11 percent aluminum, 38 percent niobium, 3.8 percent vanadium and the balance titanium (Ti11Al38Nb3.8V), near alpha aluminide titanium alloys such as a high strength titanium alloy having a composition by weight percent of 6 percent aluminum, 3 percent tin, 4 percent zirconium and the balance titanium (Ti6Al3Sn4Zr or Ti1100), alpha/beta aluminide titanium alloys such as a high strength titanium alloy having a composition by weight percent of 6 percent aluminum, 4 percent vanadium and the balance titanium (Ti6Al4V or Ti64), and beta aluminide titanium alloys such as a high strength titanium alloy having a composition by weight percent of 3 percent aluminum, 3 percent niobium, 15 percent molybdenum and the balance titanium (Ti3Al3Nb15Mo or Beta 21S).

These titanium aluminides and alloys further include intermetallic compounds or alloys having compositions by weight of 24 percent aluminum, 11 percent niobium and the balance titanium, having a composition by weight of 25 percent aluminum, 10 percent niobium, 3 percent vanadium, 1 percent molybdenum and the balance titanium, having a composition by weight of 6 percent aluminum, 2 percent tin, 4 percent zirconium, 2 percent molybdenum and the balance titanium, and having a composition by weight of 22 percent aluminum, 28 percent niobium and the balance titanium.

The material preferably has a thickness in the range from about 0.040 to 0.020 inches as formed by conventional hot roll forging and progressive hot rolling thickness reductions. Preferably a plurality of the conventionally formed sheets are attached together by cold welding or the like to form an initial element of significant length. The element is then advanced between a pair of pressure rolls in air at room temperature while applying forward and back tension to the element and two opposite surfaces of the element are compressed between the rolls for reducing element thickness. Preferably a pair of leaders, preferably of titanium metal which is of substantially lower cost than titanium aluminides and high strength titanium alloys, are attached to respective opposite ends of the element, preferably by lapped resistance welding or the like. The element is positioned between a pair of pressure rolls, preferably in a cluster mill of conventional type having additional roll means supporting the pair of pressure rolls, and the leaders are partially coiled on respective reels spaced on opposite sides of the mill at a substantial distance from the mill. The reels are then rotated for passing the element back and forth between the pressure rolls a plurality of times in air in room temperature so that the thickness of the element is substantially reduced by at least 15 percent during each cold rolling reduction under the tension. Where the initial thickness of the titanium element is too large to permit coiling of the element on one of the reels, leaders of substantial length are used for permitting the element to be substantially elongated without requiring coiling of the element on a reel until the element has been sufficiently reduced in thickness to be taken up on a reel. Preferably the element is removed from the mill and heated between at least some of the rolling reductions in thickness of the element to stress relieve and at least partially recrystallize the element material. Preferably the titanium material is loosely coiled with an interleaved iron aluminide material and is heated in a vacuum or in a protective atmosphere such as argon or the like, and in a preferred embodiment the thin strip or foil titanium material is heated standing on an end of the coil supported by a surrounding sleeve or housing.

In that way, the thin strips or foils of titanium aluminide and high strength titanium alloy materials are reduced in thickness with improved efficiency and substantially free of edge cracking at substantially improved cost to be adapted for use in making fiber-reinforced sheets and honeycomb structural elements for aircraft applications and the like.

DESCRIPTION OF THE DRAWINGS

Other objects, advantages and details of the novel and improved methods of the invention appear in the following detailed description of preferred embodiments of the invention, the detailed description referring to the drawings in which.

DESCRIPTION OF THE PREFERRED EMBODIMENT

Figure 1:
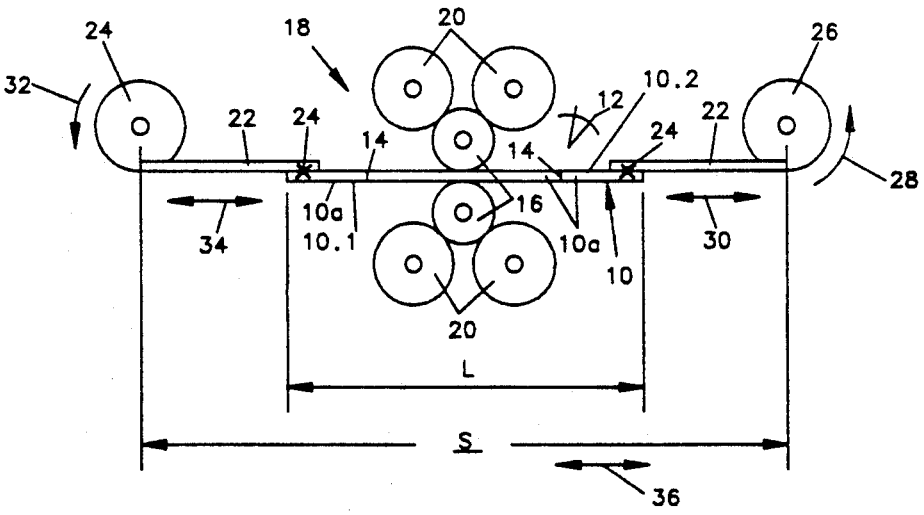
FIG. 1 is a diagrammatic side elevation view illustrating a step in the process of the invention.
Figure 2:
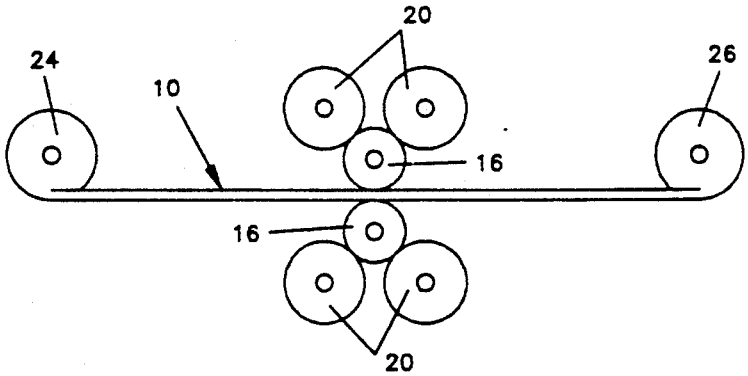
FIG. 2 is a diagrammatic side elevation view similar to FIG. 1 illustrating a subsequent step in the process of the invention.
Figure 3:
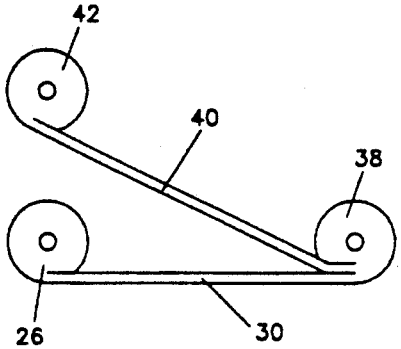
FIG. 3 is a diagrammatic side elevation view illustrating another subsequent step in the process of the invention.

Referring to the drawings, 10 in FIGS. 1-3 indicates a titanium foil or thin strip element having a selected length l, a selected width extending into the plane viewed in FIG. 1, and a selected thickness t which is provided as the starting material for the process of this invention, the titanium element comprising a titanium aluminide or high strength titanium alloy material such as might be useful for reduction to selected lesser foil or strip element thickness for use in building up fiber-reinforced sheet materials and honeycomb structural elements and the like for the aircraft industry. Preferably, for example, the starting element 10 embodies a titanium aluminide or high strength titanium alloy.

Typically, for example, the element comprises a sheet of selected titanium material selected from the group consisting of alpha/alpha-2 titanium aluminides such as an intermetallic compound having a composition by weight percent of 8.5 percent aluminum, 5 percent niobium, 1 percent molybdenum, 1 percent zirconium, 1 percent vanadium and the balance titanium (Ti8.5Al5Nb1Mo1Zr1V), alpha-2 titanium aluminides such as an intermetallic compound having a composition by weight percent of 14 percent aluminum, 21 percent niobium and the balance titanium (Ti14Al21Nb), superalpha-2 titanium aluminides such as an intermetallic compound having a composition by weight percent of 14 percent aluminum, 20 percent niobium, 3.2 percent molybdenum, 2 percent vanadium and the balance titanium (Ti14Al20Nb3.2Mo2V) and such as an orthorhombic intermetallic compound having a composition by weight percent of 11 percent aluminum, 38 percent niobium, 3.8 percent vanadium and the balance titanium (Ti11Al38Nb3.8V), near alpha aluminide titanium alloys such as a high strength titanium alloy having a composition by weight percent of 6 percent aluminum, 3 percent tin, 4 percent zirconium and the balance titanium (Ti6Al3Sn4Zr or Ti1100), alpha/beta aluminide titanium alloys such as a high strength titanium alloy having a composition by weight percent of 6 percent aluminum, 4 percent vanadium and the balance titanium (Ti6Al4V or Ti64), and beta aluminide titanium alloys such as a high strength titanium alloy having a composition by weight percent of 3 percent aluminum, 3 percent niobium, 15 percent molybdenum and the balance titanium (Ti3Al3Nb15Mo or Beta 21S).

These titanium aluminides and alloys further include intermetallic compounds or alloys having compositions by weight of 24 percent aluminum, 11 percent niobium and the balance titanium, having a composition by weight of 25 percent aluminum, 10 percent niobium, 3 percent vanadium, 1 percent molybdenum and the balance titanium, having a composition by weight of 6 percent aluminum, 2 percent tin, 4 percent zirconium, 2 percent molybdenum and the balance titanium, and having a composition by weight of 22 percent aluminum, 28 percent niobium and the balance titanium.

Such starting element materials are commercially available and are commonly produced by hot roll forging from a cast ingot and by hot rolling reduction of the ingot in a protective atmosphere down to sheet or strip sizes on the order of 3 by 8 feet having a thickness on the order of 0.040 to 0.020 inches. Typically the sheets or strip elements are commercially available in fully annealed condition and for the purposes of this invention are slit to a desired lesser width for subsequent processing in accordance with this invention. Preferably two or more strips 10*a* cut from the commercially available sheets are secured together end-to-end in sequence by cold butt welding or by resistance welding or the like as is diagrammatically indicated at 12 in FIG. 1 to provide the starting element with seams 14 and with a desired initial length l such as 5 to 25 feet or the like.

The starting element 10 is disposed between a pair of pressure rolls 16 of a conventional cluster rolling mill 18 so that the pressure rolls are adapted to compress the two opposite surfaces 10.1, 10.2 of the element between the rolls to reduce the thickness of the element and produce a corresponding increase in the length of the element, the cluster mill having cluster roll means 20 arranged to support and provide very high rolling pressures to the rolls 16. Preferably the mill is selected to provide rolling pressures on the order of 300,000 psi to the element 10 passed between the rolls using pressure rolls 16 having diameters in the range from 0.812 to 1.442 inches. Preferably the pressure rolls are provided with a rough surface finish on the order of 16 RMS by sand blasting or the like for permitting the pressure rolls 16 to make a substantial reduction in thickness of the element 10 in a single rolling pass.

Preferably the starting element 10 is provided with a pair of leaders 22 which are attached to respective opposite ends of the element 10 by riveting or welding or the like to permit the leaders to be pulled for applying substantial tension forces to the material of the starting element. The leaders comprise strips of metal having substantial strength and preferably having relatively greater ductility for a given thickness than the material of the element 10. Preferably the leaders comprise strips of pure titanium metal which are secured to opposite ends of the element 10 by lap welds using resistance welding as indicated at 24 in FIG. 1. Preferably the leaders have a width at least as great as the element 10 and have a thickness selected to be as great as possible while still permitting the leaders with their selected ductility to be wrapped or coiled on respective pay-out and take-out reels 24 and 26 as is diagrammatically indicated in FIG. 1.

The take-up reel 26 is initially rotated as indicated by the arrow 28 in FIG. 1 to advance the element 10 in a first direction toward the take-up reel 26 to permit the thickness of the element 10 to be reduced between the pressure rolls 16 in a first rolling thickness reduction pass. The take-up reel is rotated at a selected speed to provide a substantial forward tension to the material of the element 10 as is diagrammatically indicated by the arrow 30 in FIG. 1 while the pay-off reel 24 is rotated in the direction 32 usually at a relatively slower rate to provide a substantial back tension in the element material as indicated at 34 in FIG. 1. Preferably the functions as well as the directions and relative rates of rotation of the reels 24 and 26 are then reversed for advancing the element 10 in an opposite direction back between the pressure rolls 16 toward the reel 24 in a second rolling thickness reduction pass. That is, the direction and relative speeds of rotation of the reels 24 and 26 are continuously adjusted relative to each other for moving the element 10 back and forth in a series of thickness reduction passes between the rolls 16 as indicated by arrow 36 in FIG. 1, the element having the described forward and back tension thereon during each of the passes. During that movement of the element 10, the leaders 22 are repeatedly coiled and uncoiled on the reels 24 and 26. Where the initial thickness of the starting element 10 is too great to permit the element material to be coiled on the reels 24 and 26 as will sometimes be the case, the reels 24 and 26 are spaced at a distance s from each other on opposite sides of the rolling mill 18 sufficient to permit the element thickness to be reduced to a level permitting the element material to be coiled on the reels 24 and 26 before the length of the element is increased to the point permitting coiling of the element material on the reels 24 and 26 as shown in FIG. 2.

In that arrangement, the element 10 is passed between the pressure rolls 16 cold in an air atmosphere and is subjected to sufficient compressive force between the rolls 16 and to sufficient forward and back tension between the reels 24 and 26 to reduce the thickness of the element 10 to a substantial extent during each rolling thickness reduction pass, the relationship of the tension forces to the compressive forces being adjusted to accomplish substantial reduction in the thickness of the element while avoiding any substantial edge cracking in the element as it is reduced in thickness. That is, the element 10 is compressed between the pressure rolls 16 at room or ambient temperature in air without benefit of any protective atmosphere and it is found that, where substantial reductions are taken, the use of substantial tension forces prevents edge cracking even in the case of very thin strips of foil materials down to as small as 0.002 inches and the like. Preferably, for example, the thickness of the element 10 is reduced by at least about 15 percent during each thickness reduction pass, and the tension forces applied to the element material are continuously adjusted for each pass to be within about 30 to 40 percent of the yield strength of the element material as it is subjected to compression by the pressure rollers 16.

Figure 4:
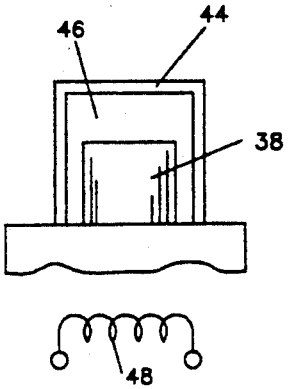
FIG. 4 is a diagrammatic side elevation view illustrating an additional subsequent step in the process of the invention.

Preferably the element material is periodically removed from the reels 24 and 26 and preferably separated from the leaders and is subjected to heat treatment in a vacuum or protective atmosphere to stress relieve and at least partially recrystallize the element material to prepare the element for subsequent additional thickness reduction steps. Preferably the element material is uncoiled from the reel 26 and is coiled loosely on a heat-treatment support reel 38 as is shown diagrammatically in FIG. 3. Preferably the element material is interleaved with a coil of iron aluminide material 40 fed from a corresponding supply reel 42. The support reel 38 is then stood on end in a conventional bell annealing furnace 44 where the element materials is heated to a stress relieving and partially recrystallizing temperature in a vacuum or in a protective or non-oxidizing atmosphere 46 of argon or the like as is diagrammatically indicated at 48 in FIG. 4. In that arrangement, the iron aluminide material is received between convolutions of the element material in the coil 38 to support the thin element material and to prevent bonding of the element convolutions to each other during the heat-treatment. Preferably, for example, the noted titanium aluminide and high strength titanium alloy materials are heated to a temperature in the range from about 1400° F. to 1850° F. for a period of 5 minutes to 1 hour. After the heat-treatment, the coil of element material is permitted to cool and is again mounted by use of the leaders 22 on the reels 24 and 26 to be further reduced in thickness between the pressure rolls 16 if desired.

In that method, it is found that the thickness of titanium aluminide or high strength titanium alloy thin strip materials are easily economically reduced to foil thickness dimensions substantially free of edge cracking along the lengths of the foil materials. For example, thin strip materials having a starting thickness on the order of 0.040 inches are quickly reduced to a thickness of 0.002 inches in ten or less thickness reduction passes. Further, the surface conditions of the foil materials are maintained free of development of such surface textures as have sometimes made hot rolled titanium foil materials become excessively brittle.

EXAMPLE A

In one exemplary embodiment of the invention, a starting element 10 formed of a fully annealed Ti8.-5Al5Nb1Mo1Zr1V material having a length of 8 feet, a width of 16 inches and a thickness of 0.016 inches is mounted on reels 24 and 26 and is advanced between pressure rolls 16 of a cluster mill in air at room temperature with initial forward tension of 20,000 lbs. and back tension of 20,000 lbs. Sufficient compressive force is applied for reducing the element thickness in air at room temperature by 15 percent. The reduced element is then passed back between the pressure rolls with corresponding pressure and tension to produce a total of 25 percent reduction in the element thickness to 0.012 inches permiting the element material to be easily coiled on one of the reels 24 or 26. The reduced element is then transferred to a support coil with an interleaving of iron aluminide separator, is mounted on end in a bell annealing furnace, is heated to a temperature of 1825° F. for 1 hour in an argon atmosphere to stress relieve and at least partially recrystallize the element material, and is then cooled again to room temperature and remounted between the pressure rolls on the reels 24 and 26. The element is again subjected to compression between the rolls 16 with comparable force and applied tension several times to provide a further 25 percent reduction in thickness of the element to about 0.009 inches. After removal and heat treatment of the element material and remounting of the element several more times, the element material is reduced to a thickness of 0.004 inches and is heat treated a final time to provide the element material in annealed condition. The resulting foil material requires only 15–20 reduction passes total and is found to have a length of about 40 feet and to be substantially free of undesirable surface textures and free of edge cracks and is suitable for use in building up a fiber-reinforced material or honeycomb structure in conventional manner.

EXAMPLE B

In another exemplary embodiment of the method of the invention, a starting element formed of a Ti-6Al3Sn4Zr (Ti1100) material having a length of 8 feet, a width of 16 inches and a thickness of 0.020 inches is mounted on reels 24 and 26 and passed between pressure rolls 16 in a cluster mill in air at room temperature with initial forward tension of 40,000 lbs. and back tension of 40,000 lbs. and with sufficient compressive force between the pressure rolls for reducing the element thickness by 40 percent. The reduced element is passed back and forth between the pressure rolls with comparable reduction in thickness on each pass to produce a total of 45 percent reduction in element thickness to a thickness of 0.011 inches. The reduced element material is transferred to a support roll with loosely wound convolutions and with an iron aluminide separator and is mounted on end in a bell annealing furnace. The coil is heated to a temperature of 1650° F. for 1 hour in argon or a vacuum to stress relieve and at least partially recrystallize the element material. The coil is then cooled to room temperature and is again subjected to thickness reduction and heat treatment several more times in the same manner as above described to reduce element material thickness to 0.002 inches. After a final heat treatment in the same manner for annealing the resulting foil material, the foil has a length of about 80 feet and is again found to be free of desirable surface textures and edge cracks even though the foil has been formed with only about 20 thickness reduction passes.

EXAMPLES C

In another exemplary embodiment, a starting element of Ti6A14V material, having a length of 10 feet, a width of 16 inches and a thickness of 0.026 inches is mounted between pressure rolls and advanced between reels 24 and 26 as described with reference to Examples A and B. With forward and back tension of 55,000 lbs. and 55,000 lbs., and with reduction in thickness of 50% in air at room temperature, the element is reduced to a thickness of 0.013. The element materials are then interleaved with iron aluminide separators in loosely wound convolutions and are heated in bell annealing furnaces in argon atmospheres at a temperature of 1400° F. for 1 hour to stress relieve and partially recrystallize the element material. The element material is then cooled to room temperature and is then subjected to further thickness reduction and heat treatment several more times in the manner described above to reduce the element material to a thickness of 0.004 inches. After final heat treatment in the manner described, the foil material has a length of over 78 feet and is found to be free of edge cracks and undesirable surface textures.

EXAMPLE D

In another exemplary embodiment, a starting element of Ti3Al3Nb15Mo (Beta 215) material respectively having a length of substantial feet, a width of 25 inches and a thickness of 0.026 inches, is mounted between pressure rolls and advanced between reels 24 and 26 as described with reference to Examples A and B. With forward and back tensions of 40,000 lbs. and 40,000 lbs., and with reduction in thickness of 50% in air at room temperature, the element is reduced to a thickness of 0.0130 inches. The element material is then interleaved with an iron aluminide separator in loosely wound convolutions and is heated in a bell annealing furnace in an argon atmosphere at a temperature of 1550° F. for 3.5 minutes to stress relieve and partially recrystallize the element material. The element material is then cooled to room temperature and is subjected to further thickness reduction and heat treatment several more times in the manner described above to reduce each of the element material to a thickness of 0.004 inches. After final heat treatment in the manner described, the foil material has a greatly increased field and is found to be free of edge cracks and undesirable surface textures.

In that way, the thin strip or foil elements of titanium aluminide and high strength titanium alloy materials are produced with good foil characteristics in an economical and commercially feasible manner. The leaders are easily cut from the foil materials and if desired, narrow edge trimming is carried out in conventional manner to provide foil materials suitable for use in building up fiber-reinforced materials and honeycomb structures for the aircraft industry.

It should be understood that although particular embodiments of the method of the invention have been described by way of illustrating the invention, the invention includes all modifications and equivalents of the disclosed embodiments falling within the scope of the appended claims.

I claim:

1. A method for reducing thickness of a titanium alloy foil or thin strip element having low ductility comprising the steps of providing an element of titanium alloy material having selected length and width and relatively much smaller thickness, advancing the element between a pair or pressure rolls at room temperature while applying a forward tension force to the element and a back tension force to the element, and compressing two opposite surfaces of the element between the rolls to reduce the thickness of the element free of cracking of the element.

2. A method according to claim 1 wherein the element material is selected from the group of titanium intermetallic compounds and high strength titanium alloys consisting of alpha/alpha-2 titanium aluminide intermetallic compounds, alpha-2 titanium aluminide intermetallic compounds, superalpha-2 titanium aluminide intermetallic compounds, near alpha aluminide high strength titanium alloys, alpha/beta aluminide high strength titanium alloys, and beta aluminide high strength titanium alloys, the element is advanced between the pair of pressure rolls at room temperature a plurality of times while applying a forward tension force to the element and a back tension force to the element each time, and compressing the two opposite surfaces of the element between the rolls to reduce the thickness of the element each time.

3. A method according to claim 2 wherein the element is heated to stress relieve and at least partially recrystallize the element material at least one time after the two opposite surfaces of the element are compressed between the rolls to reduce the thickness of the element.

4. A method according to claim 3 wherein the element is heated to stress relieve and at least partially recrystallize the element material a plurality of times after respective compressions of the two opposite surfaces of the element between the rolls to reduce the thickness of the element, and the element is cooled to room temperature before any subsequent compression of the two opposite surfaces of the element between the rolls to reduce the thickness of the element.

5. A method for reducing thickness of a titanium foil alloy or thin strip element having low ductility comprising the steps of providing an element of titanium alloy material having selected length and width and relatively much smaller thickness, advancing the element between cluster roll means at room temperature while applying a forward tension force to the element and a back tension force to the element, and compressing two opposite surfaces of the element between the rolls to reduce the thickness of the element free of cracking of the element.

6. A method for reducing the thickness of a titanium foil or thin strip element comprising the steps of providing an element of titanium material having selected length and width and relatively a much smaller thickness, attaching leaders to respective ends of the length of the element, advancing the element between a pair of pressure rolls of a cluster mill at room temperature a plurality of times in an air atmosphere while applying a forward tension force to the element by pulling on one of the leaders and applying a back tension force to the element by partially restraining advance of the other leader, compressing two opposite surfaces of the element between the rolls to reduce the thickness of the element by at least 15 percent each time, and heating the element to stress relieve and at least partially recrystallize the element material a plurality of times after respective compressions of the two opposite surfaces of the element to reduce the thickness of the element, the element being cooled to room temperature before any subsequent compression of the two opposite surfaces of the element between the rolls to reduce the thickness of the element free of cracking of the element.

7. A method according to claim 6 wherein the element material is selected from the group of titanium intermetallic compounds and high strength titanium alloys consisting of an alpha/alpha-2 titanium aluminide intermetallic compound having a composition by weight percent of 8.5 percent aluminum, 5 percent niobium, 1 percent molybdenum, 1 percent zirconium, 1 percent vanadium and the balance titanium, an alpha-2 titanium aluminide intermetallic compound having a composition by weight percent of 14 percent aluminum, 21 percent niobium and the balance titanium, a superalpha-2 titanium aluminide intermetallic compound having a composition by weight percent of 14 percent aluminum, 20 percent niobium, 3-2 percent molybdenum, 2 percent vanadium, and the balance titanium, an orthorhombic superalpha-2 titanium aluminide intermetallic compound having a composition by weight percent of 11 percent aluminum, 38 percent niobium, 3.8 percent vanadium and the balance titanium, a near alpha aluminide high strength titanium alloy having a composition by weight percent of 6 percent aluminum, 3 percent in, 4 percent zirconium and the balance titanium, an alpha/beta aluminide high strength titanium alloy having a composition by weight percent of 6 percent aluminum, 4 percent vanadium and the balance titanium, and a beta aluminide high strength titanium alloy having a composition by weight of 3 percent aluminum, 3 percent niobium, 15 percent molybdenum and the balance titanium.

8. A method according to claim 6 wherein the element is coiled loosely in interleaved relation with a coil of iron aluminide material during heating thereof to stress relieve and at least partially recrystallize the element material.

9. A method according to claim 6 wherein the leaders each comprise titanium metal lap welded by resistance welding to the element.

10. A method according to claim 7 wherein the leaders are partially coiled on respective reels and the reels are rotated in a first direction to pay out and take-up the respective leaders at relatively different rates for advancing the element in the first direction between the rolls while applying the forward and back tension to the element at least one of the times while the two opposite surfaces of the element are compressed between the rolls to reduce the thickness of the element.

11. A method according to claim 8 wherein the element is coiled loosely in interleaved relation with a coil of iron aluminide material during heating thereof to stress relieve and at least partially recrystallize the element material.

12. A method according to claim 10 wherein the reels are rotated in an opposite direction to pay out and take up the respective leaders at relatively different rates for advancing the element in the opposite direction between the rolls while applying the forward and back tension to the element at least one of the times while the two opposite surfaces of the element are compressed between the rolls to reduce the thickness of the element.

13. A method according to claim 12 wherein the element is provided with a selected initial thickness larger than is coilable on the reels and is reduced at least to a lesser thickness coilable on the reels, and the reels are spaced to permit elongation of the element with reduction of the element to the lesser thickness free of coiling of the element on the reels.

14. A method according to claim 13 wherein the element is at least partially coiled on at least one of the reels in advancing the element in at least one of the directions after reduction of the element to the lesser thickness.

15. A method according to claim 14 wherein a plurality of lengths of titanium foil or thin strips are initially secured together in sequential relation to each other for forming the element.

* * * * *